United States Patent [19]

Graniou

[11] Patent Number: 4,520,487

[45] Date of Patent: May 28, 1985

[54] HIGH TEMPERATURE ELECTRIC FURNACE WITH METALLIC RESISTANCES IN THE FORM OF HOLLOW VERTICAL HEATING TUBES

[76] Inventor: Louis Graniou, Villa Maeva, Chemin de l'Archet Superieur, 06200 Nice, France

[21] Appl. No.: 473,998

[22] Filed: Mar. 10, 1983

[30] Foreign Application Priority Data

Mar. 10, 1982 [FR] France ..... 82 04281
Jan. 31, 1983 [FR] France ..... 83 01585

[51] Int. Cl.[3] ..... H65B 3/40

[52] U.S. Cl. ..... 373/134; 338/279; 338/295; 373/117; 373/127; 373/128

[58] Field of Search ..... 373/117, 132, 133, 134, 373/119, 129–131, 137, 127, 128; 338/279–295; 219/539, 541, 350–352

[56] References Cited

U.S. PATENT DOCUMENTS 1,809,227 6/1931 Baily ..... 373/117
1,901,499 3/1933 Fahrenwald ..... 373/134 X
3,506,771 4/1970 Cole, Jr. ..... 373/134
3,985,946 10/1976 Werych ..... 373/128
4,093,816 6/1978 Case .
4,101,724 7/1978 Heine et al. .
4,132,886 1/1979 Blodgett ..... 373/127
4,135,053 1/1979 Kastilahn et al. ..... 373/127

FOREIGN PATENT DOCUMENTS 658966 6/1929 France .
336078 10/1930 United Kingdom .
528857 11/1940 United Kingdom ..... 373/117

*Primary Examiner*—A. D. Pellinen
*Assistant Examiner*—Gregory D. Thompson
*Attorney, Agent, or Firm*—Young & Thompson

[57] ABSTRACT

A high temperature electric furnace has along its side walls vertical hollow electric resistance heating tubes (57) interconnected in serpentine fashion by conductive bridge plates (55). The tube ends and bridge plates are so contoured as to provide substantially uniform resistance along all possible current paths, thereby to avoid preferential current conduction with localized overheating. The bridge plates (55) and/or the tube ends are supported by air-cooled hollow hangers (28,45).

10 Claims, 17 Drawing Figures

HIGH TEMPERATURE ELECTRIC FURNACE WITH METALLIC RESISTANCES IN THE FORM OF HOLLOW VERTICAL HEATING TUBES

The invention has for its object a high temperature electric furnace.

The metallic resistances which operate at high temperature, near their melting point, permit heating charges to temperatures near theirs, with maximum efficiency, if the furnaces are well designed, if their control is well arranged and if the heating elements substantially cover their walls.

The study of prototype furnaces by the inventor has resulted in good mathematical models for the calculation of large furnaces as well as the need to assume, as the basis of control, the temperature of the heating elements themselves. The high temperature of the resistances provides very high surface voltages when the temperature of the metal of the heating elements can be maintained, no matter what the nature of these elements. To this end, the temperature control need no longer be according to the ambient of the furnace, but can use as the temperature base the resistances and hence the need to provide measuring means in the heating body itself.

Known electrical furnaces which permit obtaining high temperatures of the order of 1250° C., have a number of drawbacks. These furnaces have a power of the order of 500 to 1000 kilowatts. The electronic resistances are in the form of a suitable known alloy such as nickel-chrome, but cast, which is to say that the heating bodies serve as resistances. The assembly is in the form of a sinuous hollow tube.

These known tubes which serve as resistances do not have a constant cross section; it follows that at the level of the furnace, the temperature is not very uniform. Moreover, this type of electrical furnace must be very precisely regulated.

Along the heating tubes, there are cold points and hot points, as is known, but the difficulty resides in the fact that it is difficult to measure, in a precise manner, the temperature of the metal. Moreover, the fabrication of these sinuous tubes by casting, explains the fact that portions will be irregular and of V-shape.

Another major drawback is known furnaces exists in the securement of said heating tubes. All these advantages are not without several problems of which the principal one is the difficulty of securing these resistances on the available walls of ceramic fibers. If their arrangement in the hearth or the arch presents no problem, their securement to the pillars on the fibrous walls, subjects the flow to high temperature. It is thus necessary to provide mountings which solve this problem. The heating tubes are generally maintained in place in the furnace by securement tongues. These securements tongues are used because of the poor thermal regulation of the furnaces and the weakness of the welds whose temperature rises too high.

Accordingly, the invention avoids these two principal drawbacks: the poor thermal regulation of high temperature electric furnaces, and the securement of the heating tubes.

To this end, the high temperature electric furnace is comprised of vertical hollow heating tubes, electrically interconnected by bridge plates, welded and maintained at the level of said bridge plates by attachment means which are hollow attachment tubes which are insulated and secured to the walls of said furnace.

Cooling means maintain the temperature low, specifically at the level of the welds of the bridge plates which interconnect two vertical hollow heating tubes. The cooling means are hollow vertical securement tubes in which compressed air circulates.

The hollow vertical tube serving as securement is therefore cooled. This hollow securement tube is of stainless steel or other suitable material and is insulated by refractory elements, except at the level of its contact with the bridge plate which electrically connects two hollow heating tubes. The hollow heating tubes are not fabricated by casting but are drawn and welded.

The securement tubes which support and cool the hollow vertical conductive heating tubes, may comprise means individual to each tube to regulate the inlet and outlet airflow. According to a modification of the invention, the securement tubes are comprised by at least two coaxial tubes, over at least a portion of their length, the entry of the cold air being by way of the outer peripheral tube and the outlet of the air by the interior tube; said interior tube is preferably of stainless steel and is centered by three enlargements spaced 120° on the lower end of said tube. The insulation means of the securement tubes, at particular points, may comprise means such as an asbestos winding of at least two layers.

The bridge plate according to the invention has been specifically studied as to its electrical conductivity. The bridge plate is a solid bi-symmetrical crosspiece. This bridge plate permits passing current from one vertical hollow heating tube to the next in regular manner without cold spots or hot spots, by means of a line of electric arc welding performed along a curve obtained by the interconnection of the points which connect said hollow heating tube and said bridge plate.

The heating resistances, which are hollow metallic heating tubes, are interconnected by the bridge plates or cross members. These bridge plates have a shape such as to avoid any local heating effect in the interconnections of the two successive parallel parts. This heating is due to the preferential current flow along the shortest path. This drawback is avoided by reinforcing the metal sections in this region. This preferential flow is eliminated by means equalizing the resistances of the elemental paths between generatrices associated with the two connected heating elements. To this end, there is used a bridge plate of large cross section, bent to be welded to the two elements of the hollow heating tubes whose corresponding ends are cut on a profile giving exactly this equality of elemental resistance between pairs of associated generatrices. The solution followed consists in connecting the two heating elements by an electrical connector secured to the ends of the two elements, whereby there will be equal electrical resistance through the elemental paths between the various pairs of points situated on the two sections of these two elements, and equally distant from this connection. This involves cutting off the ends of the heating elements so as to integrate into these elemental paths a length of these elements, which is longer as the path in the connection is shorter. This cutting off of the heating tube ends is more complicated the closer is the size of the cross section of the electrical connection to that of the heating elements, and as the current density of the latter is higher. This cutting off of the ends of the hollow heating tubes should not be orthogonal.

For the current density values usually used, there can be good homogeneity of the resistance of the elemental paths by a simple flat cutting, but on the bias, of the heating elements, when the section of the electrical connector is substantially greater than that of the heating element. The profile of this bias cut is determined by the relationship of the two cross sections (hollow heating tubes and bridge plate).

This mode of electrical connection between heating elements giving rise to equality or substantial equality of the various elemental electric current paths, is hereinafter referred to by the phrase "equicurrent bridge plates".

The invention relates to an equicurrent bridge plate of large section, bent so as to be welded to the two hollow heating tubes whose corresponding ends are cut on an angle giving exactly the overall elemental resistance equality between the associated pairs of generatrices. The angles of these bias cuts are selected with regard to the sections of the equicurrent bridge plate and of the hollow heating tube, to equalize these different elemental paths.

The invention also relates to internally ventilated securement or suspension means. The heating elements are suspended from a system of hollow cooled attachment tubes, serving as a mounting, passing through the insulation of the furnace and bearing on the external casing of the furnace. These hollow cooled securement tubes, serving as a mounting, contain a refrigeration tube disposed in the bore, open at its two ends; the lower opening is located in the lower region of the hollow refrigerated attachment tube, while the upper opening, passing through the upper end of the hollow refrigerated securement tube, opens into the free air. The only opening of the hollow cooled securement tube, closed at its two ends, is located in the upper portion and is located sideways. A supply source for the refrigerant fluid under moderate pressure blows the latter into the upper portion of the hollow cooled securement tube, by that lateral opening. The fluid descends in the annular space between the hollow cooled securement tube and the cooling tube, to then use the refrigerant tube by entering its lower opening end to leave to the ambient air from the upper end of the refrigerant tube. This internally ventilated securement means is also used in the current conducting terminals, extending through the electric furnace structure, for connecting the heating elements to the mains.

Thus, the current terminals receive a thermal fluid in their ends within the furnace chamber: by radiation of the latter and by conduction of the hollow heating tubes connected to these inner ends. Moreover, these current terminals are the site of a thermal input, taken together, due to the Joule effect of the electric current passing through them.

Finally, the invention relates to the overall furnace, comprised by modular rapidly interchangeable heating elements as well as these modular elements, taken alone or in combination, which permit rapid replacement, from the outside, in case of failure of a modular heating element without having to cool the furnace.

The accompanying drawings, given by way of non-limiting example, permit easy comprehension of the invention. They show embodiments according to the invention.

FIGS. 8, 9, 10, 11, 12, 13, and 14 are plan views and half-sectional views of different embodiments of bridge plate.

Figure 15:
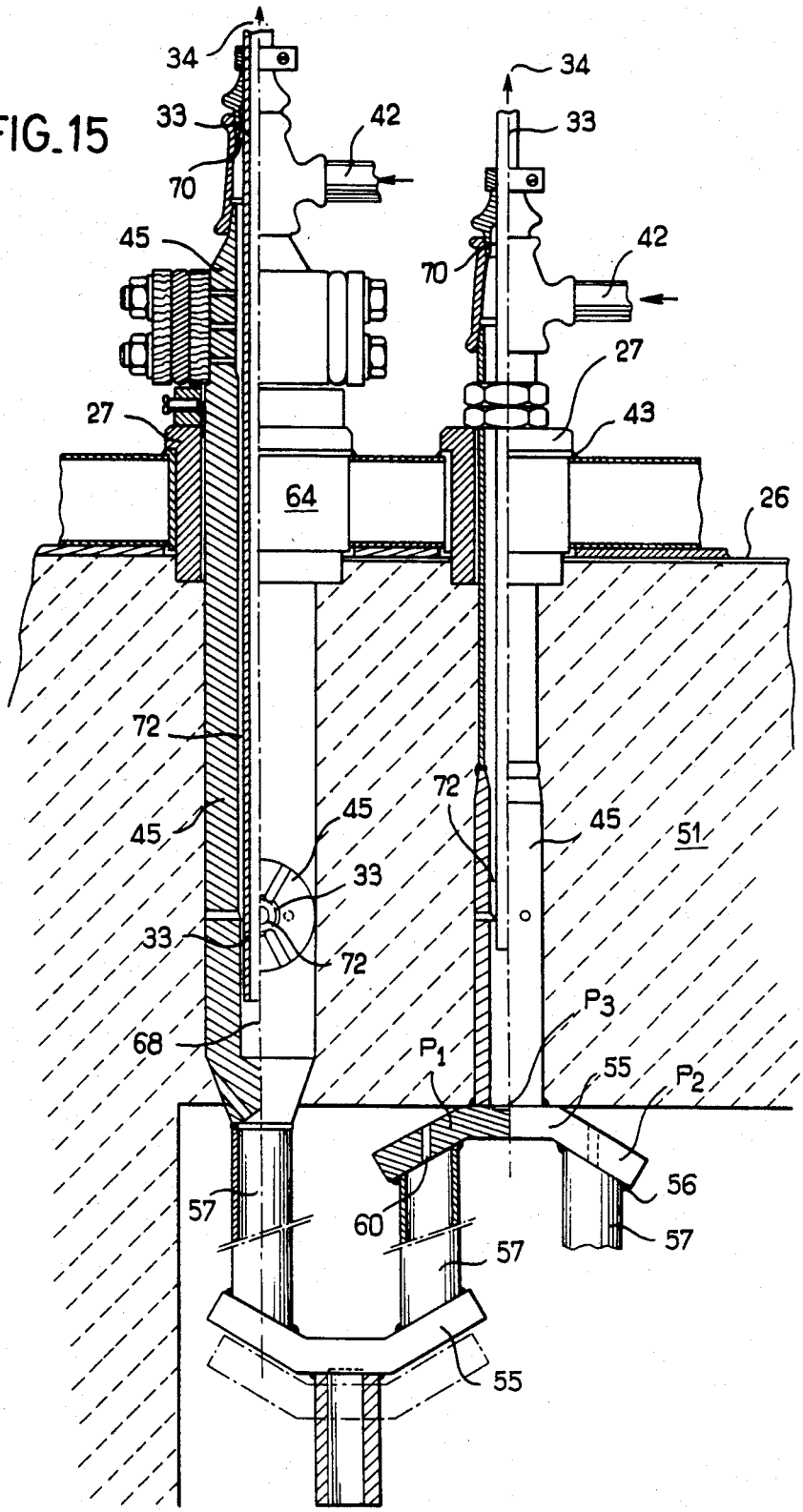

FIG. 15 is a side view and half-sectional view of the hollow securement tube, of the current supply terminal and of the hollow heating tubes.

Figure 16:
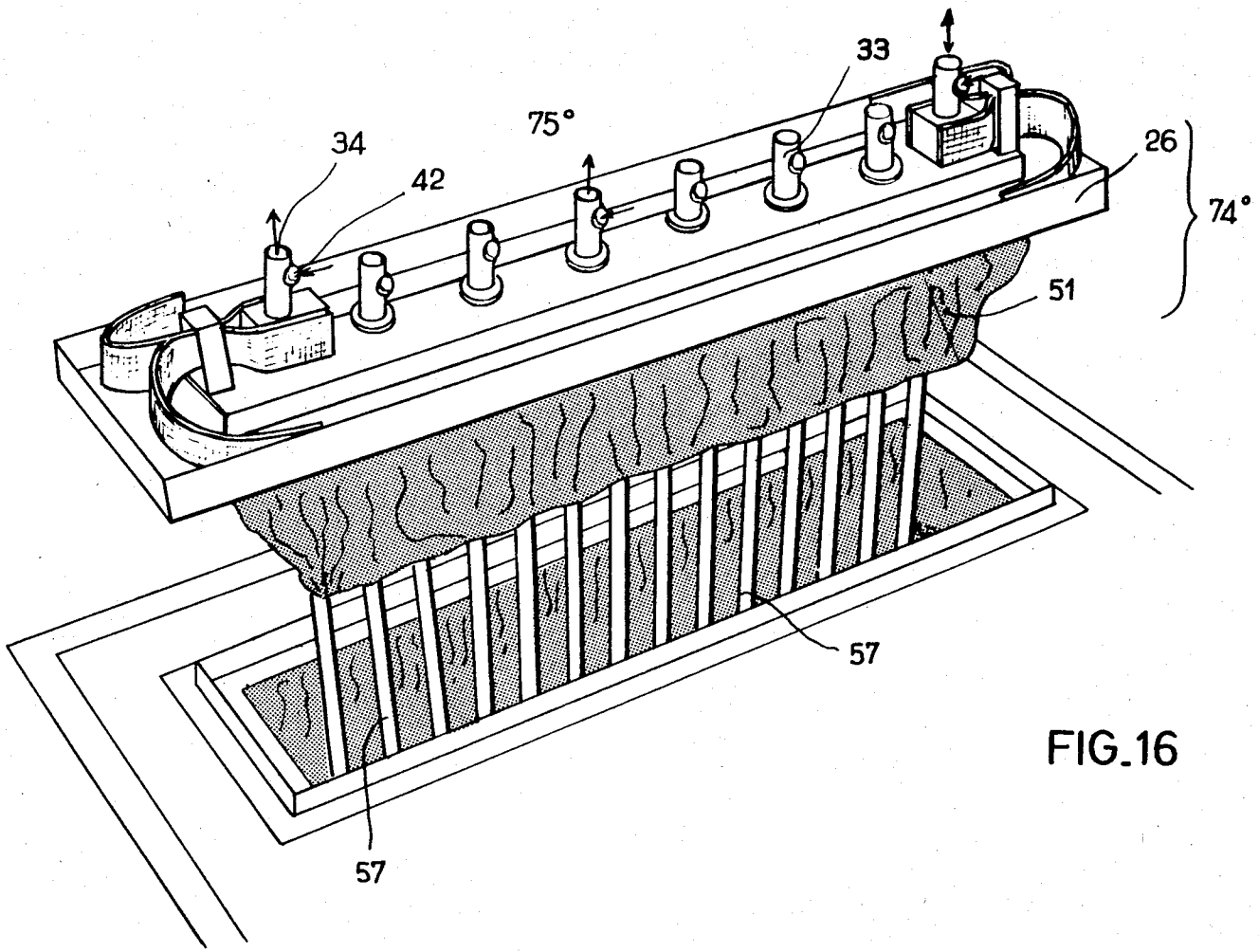

FIG. 16 is a view of an interchangeable modular heating element, seen in perspective half-way out of the furnace.

Figure 17:
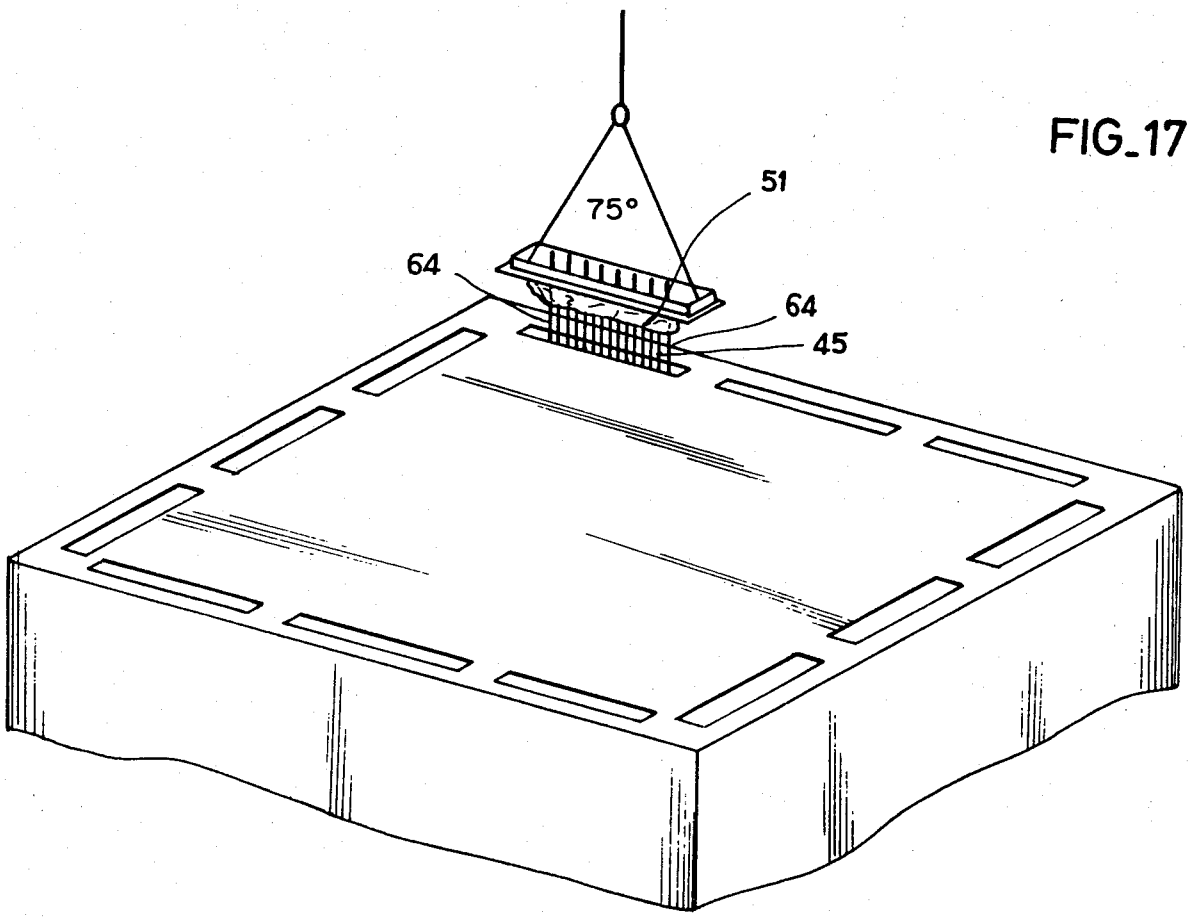

FIG. 17 is a view of a furnace, seen from above in perspective, in the course of changing a modular heating element.

Figure 1:
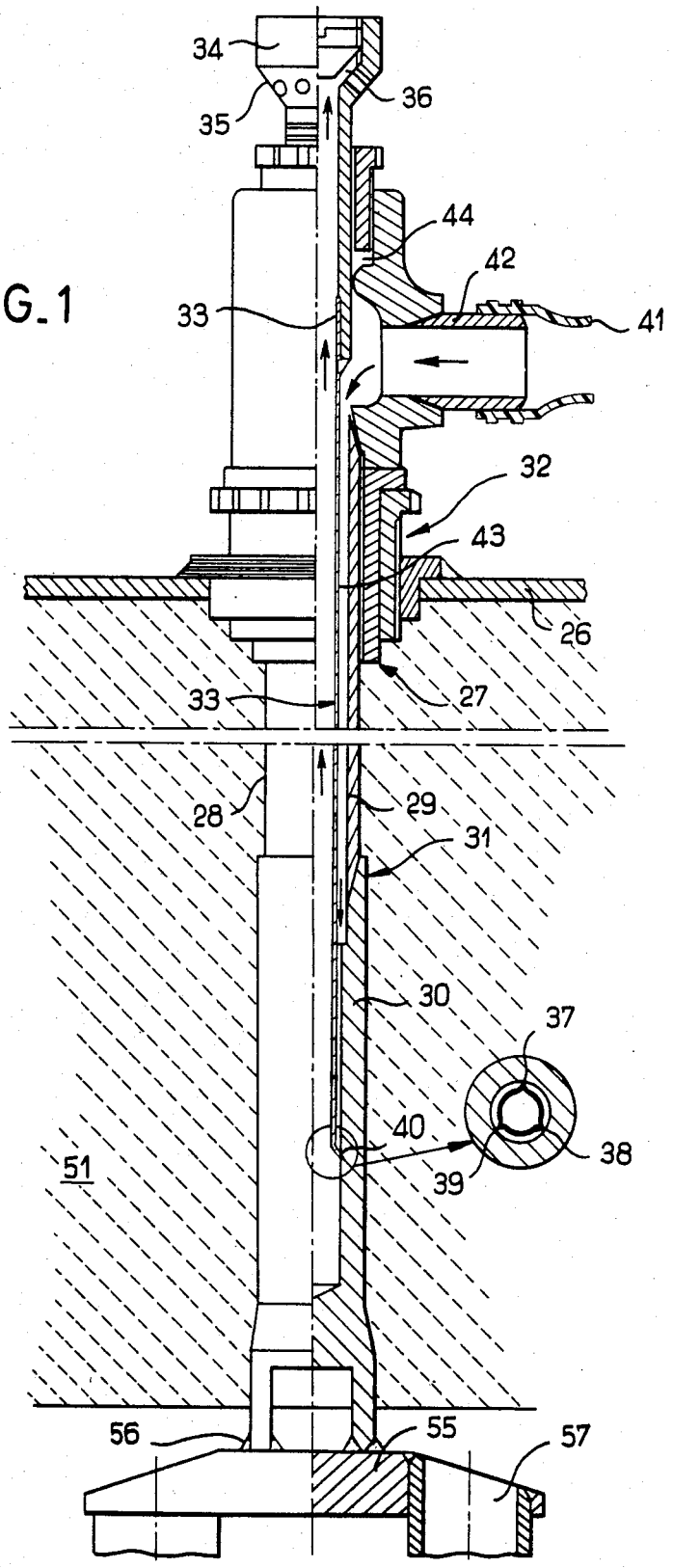
FIG. 1 is a partial cross-sectional view of a cooled securement tube with double air circulation.

In FIG. 1, in the metallic casing 26 of the furnace, a mounting tube or hanger 28 is secured by an insulating sleeve 27. This tube may be constituted by two members 29 and 30 which are joined by screw threads at 31. The adjustment of the height of suspension of the hollow vertical heating tubes (conductive tubes) is effected by a collar 32 and an insulating sleeve 27. Tube 28 therefore performs the function of a securement tube in which circulates fresh air. Tube 28 is welded at 56. In the interior of mounting tube 28 is disposed, coaxially, a tube 33 which serves for the return of the air and its evacuation through outlet 34. The adjustment of the flow of the outlet air is effected by a ring of holes 35 and by screws 36. The inner tube 33 is centered in the mounting tube 28 by three enlargements 37, 38, 39 spaced 120°, at the end 40 of said tube 33. The inlet of fresh air is by a flexible tube 41 which is secured to a connector 42 which opens into and communicates with the periphery 43 of the mounting tube 28, the air thus entering by the periphery and leaving by the center of mounting tube 28, that is to say the internal tube 33. Adjustment of the height of heat exchange is effected by a ring 44. Of course, the internal tube 33 can be extended at least until just beyond the connection 42 by which the fresh cooling air enters.

Figure 2:
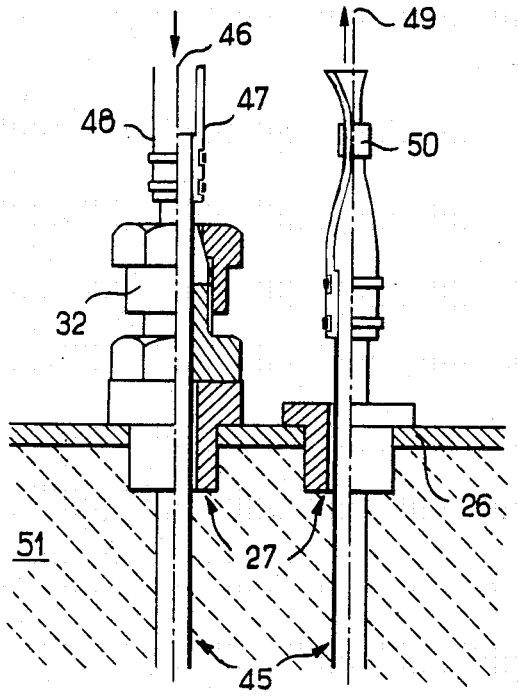
FIG. 2 is a partial cross-sectional view of a cooled securement tube according to the invention, showing particularly the regulation of the air outlet.

In FIG. 2, the mounting tube or hanger 45 is comprised by a single mounting tube with a single direction of air circulation. Fresh air enters at 46 by a flexible tube 47 and an insulator 48 and leaves by outlet 49. The flow of the outlet air 49 may be adjusted by constriction with a metal ring 50. The mounting tube 45 is, in this case, either welded at the level of the bridge plate 55, or supports the bridge plate 55.

Figure 3:
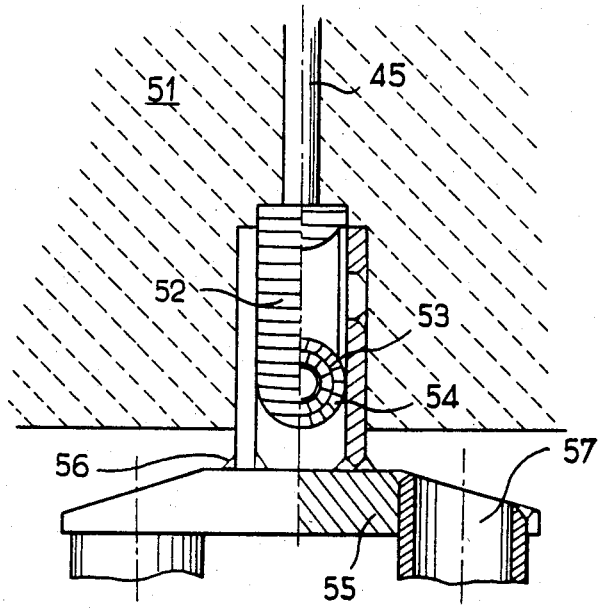
FIG. 3 is a partial cross-sectional view of a cooled securement tube according to the invention, showing particularly the insulation of the securement tube by asbestos; this view is a view of the mounting shown in FIG. 2 after rotation through 90°.
Figure 4:
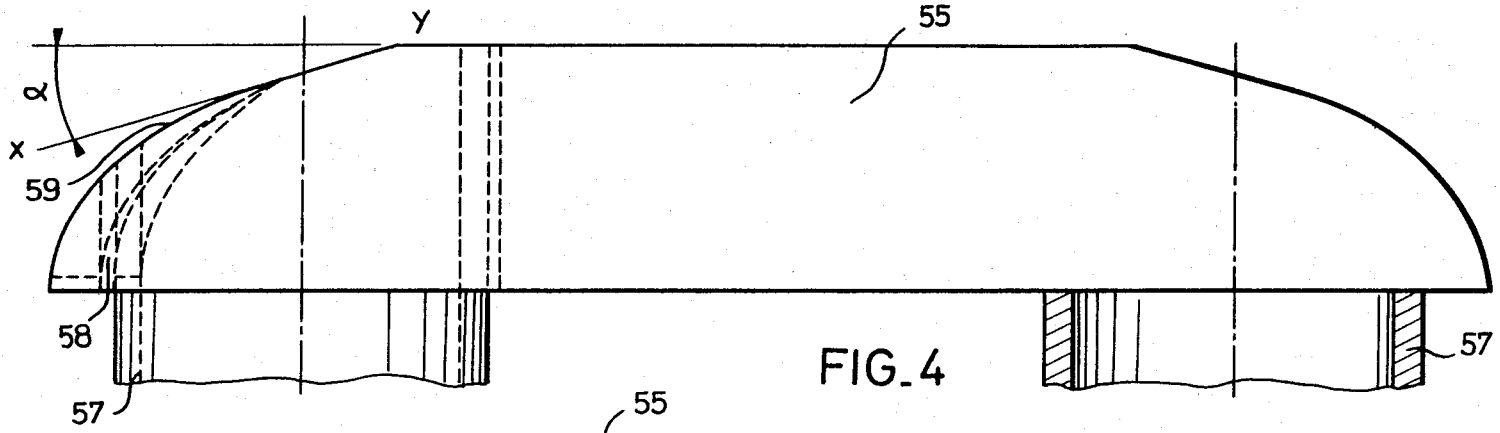
FIG. 4 is a front view of the bridge plate.
Figure 6:
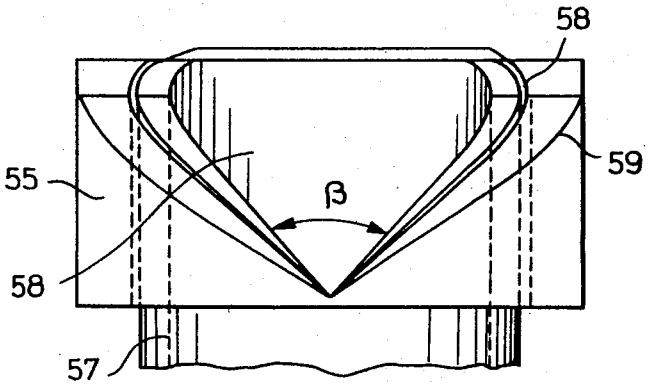
FIG. 6 is a view of the massive equicurrent bridge plate machined in a plain rectangle.
Figure 5:
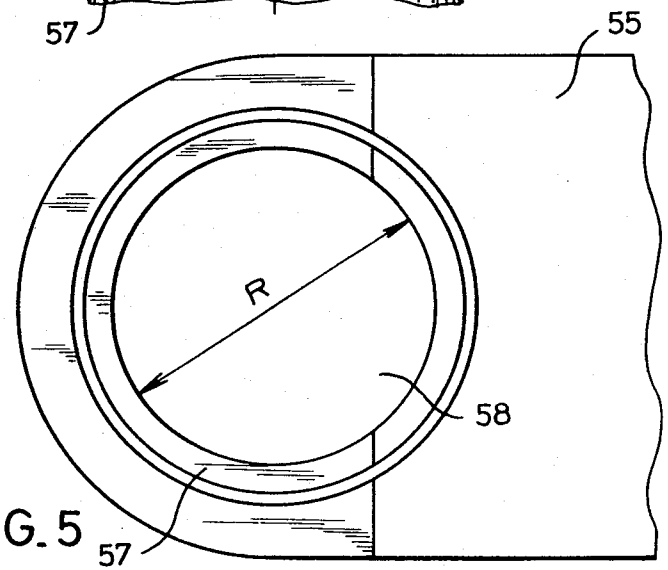
FIG. 5 is a top view of bridge plate.

The insulating element 51 is shown in all the figures, but in FIG. 3 is moreover shown the insulating element 52 such as of asbestos wrapped in two layers 53 and 54.

The bridge plate 55 permits the current to pass from one heating tube 57 to another. The current should pass from one heating tube 57 to another in uniform manner without hot or cold spots by means of a line 61 of electric arc welding performed on a curve 59 which connects said heating tube 57 to said bridge plate 55. The bridge plate 55 is initially cut from a plain metal resistive bar of the same nature as that of the heating conductive tube 57. Said heating tube 57 passes through a hole 58 in the bridge plate 59 which is at least one milimeter greater in radius R. Said heating tube 57 must be exactly centered to avoid any contact other than the weld and the weld is effectuated uniformly between the edges. The curve 59 is milled in the heating tube 57 with that milled in said bridge plate 55 by means of an electric arc using an electrode of the same metal.

The angle $\alpha$ formed by the tangent x-y to the curve 59 and the horizontality of the bridge plate 55 is about 16°. The angle $\beta$ formed on the opening of the hole 58 between the two sides of the curve 59 is about 74°.

Figure 7:
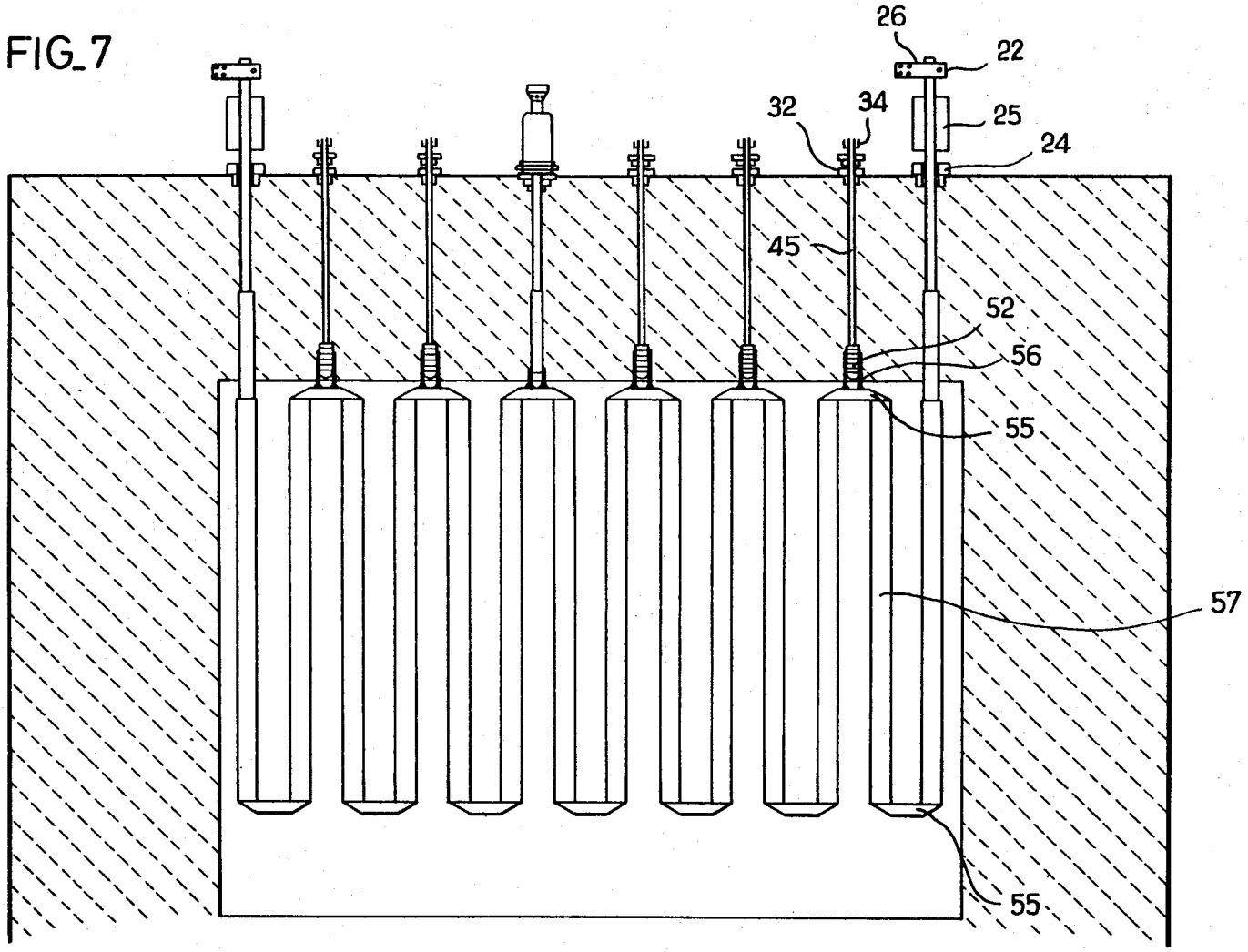
FIG. 7 is an overall view of a furnace according to the invention, with its hollow vertical heating tubes, its bridge plates, and its cooled securement tubes in which fresh air circulates.

FIG. 7 shows the overall cross-sectional view of the furnace. The connection 26 from the electric power source (not shown) is secured by a plate 22 on a terminal of the heating assembly, which terminal has cooling fins 25 thereon. This terminal passes by an insulated plug 24 through the external casing of the furnace and thence through the insulation thereof and comes into electrical and supporting contact with the first vertical hollow heating tube 57. As is evident from FIG. 7, the same construction is repeated at the other end of the assembly, to complete the circuit.

The embodiments of the preceding figures provide a solution for the mechanical support of the connector of the resistances of industrial electric furnaces operating at high temperature. This consists in decreasing the temperature of the most highly stressed pieces thanks to a securement comprised by a cooled mounting tube traversed by a cooling fluid and thermally coupled to the electrical connection formed by the bridge plate of the two ends of each pair of heating elements. These bridge plates, mechanically associated with the mountings, transmit to the latter the weight of the resistance constituted by the assembly of the heating tubes.

With the same view toward improving the mechanical strength of the mounting structures by reducing their temperature, is the elimination of locally overheated zones by the unnecessary concentration of electric currents at certain points.

Figure 8:
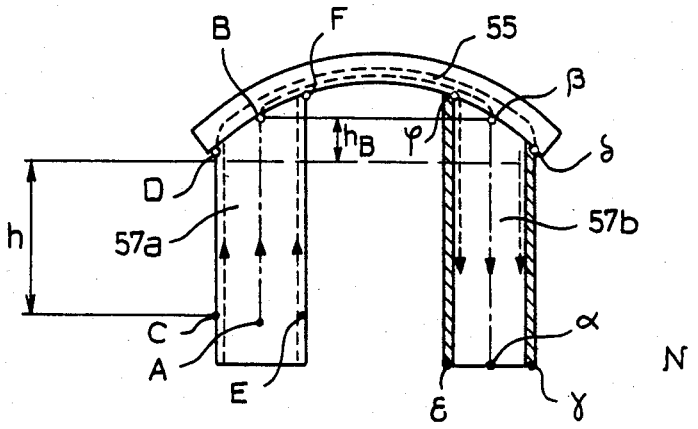

It is thus known that the connection without any precaution of two parallel heating tubes, involves a concentration of current along the more direct circuit. Thus it is that a connection, or bridge plate, such as that shown in FIG. 8, provides a current concentration in the zones A and B of the welds, to the detriment of zones C and D.

It is no less known that the practical way to reduce overheating in zones A and B consists in reinforcing the welds A and B so as to reduce the current density; thus the overheating at C and D is less.

The object of the present invention is to provide a rational solution for this.

The concentration of the current at A and B results from the well-known laws regulating electric flow of complex circuits (Ohm's law and Kirchoff's law). To obtain uniformity of current density in the welds for connection with the heating tubes, it suffices to equalize the resistances of the various possible parallel paths between two right angular sections of the heating tubes 57*a*, 57*b*, to the same level. This can be rigorously expressed by:

$$-R_{AB}+R_{B\beta}+R_{\beta\alpha}=R_{CD}+R_{D\delta}+R_{\delta\gamma}-$$
$$=R_{EF}+R_{F\rho}+R_{\rho\epsilon}$$

In which R is the resistance of the path whose ends are denoted by the letters A, $\epsilon$; each sum therefore represents the total elemental resistance encountered by the current in moving from one point of the section N of the heating tube 57*a* to the same point in this same section N of the heating 57*b*.

The practical embodiment giving equality to the elemental resistances is provided by a bridge plate having an electrical connection 55 of rectangular cross section greater than that of the two heating tubes 57*a*, 57*b* and by a profile of the ends of these two heating tubes the more complex the greater are the current densities in these heating tubes and in which the relationship between the rectangular sections of the electrical connection and the heating tubes is closer in unity.

Figure 11:
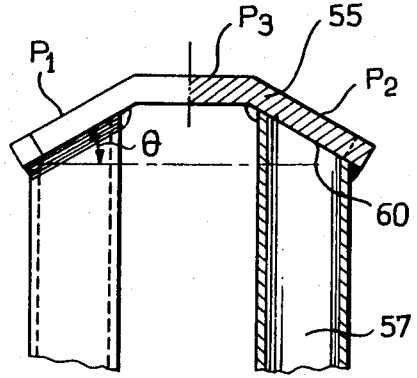

On the other hand, for current densities usually used (3 to 5 amperes/mm$^2$) and the use of an electrical connection of large cross section, greater than that of the heating tubes (ratio 3 to 4), there is obtained an end profile of the heating tubes which is very simple and easy to form (FIG. 11).

The end of the heating tubes 57*a* and 57*b* is planar. It forms an angle ($\theta$) relative to the right section. The value of this angle ($\theta$) is a function of the current density on the heating tubes, and of the ratio between the right sections of the electrical connection, or bridge plate, and that of the heating tubes. For the current values, this angle ($\theta$) is about 30°. More precisely, the equality of the resistances is not completely effected with this slanted connection, but there is however obtained a good homogeneity of the temperatures along the length of the weld strip, even with current densities greater than 5 amperes/mm$^2$.

Such an electrical connection providing acceptable homogeneity of the temperatures in the welds is provided by the equicurrent bridge plate 55. Its combination with a ventilated right connection 45, such as described above, leads to the embodiment shown in FIG. 17, combining the previous features of FIG. 1.

Figure 9:
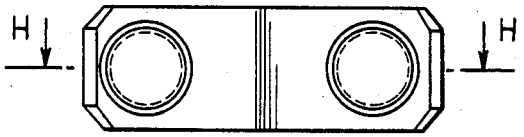
Figure 10:
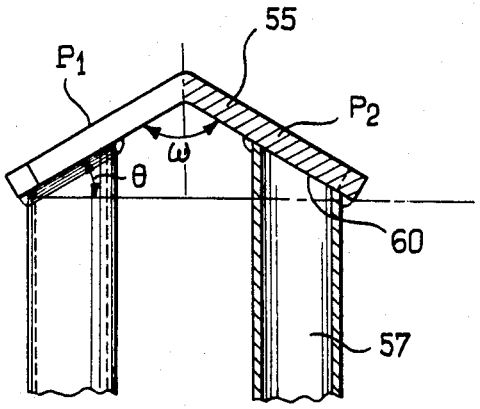

In FIGS. 9 and 10, the heating tube serving as resistance 57 is cut at its end 60 on a bias angle determined by the ratio of the two right sections of the heating tube and the bridge plate 55. This equicurrent bridge plate 55 is comprised by two planes $P_1$ and $P_2$ which form between them an angle ($\omega$). Each plane A or B forms with the horizontal plane a same angle ($\theta$). The angle $\theta$ may be about 30°.

Figure 12:
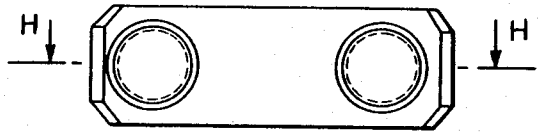

In FIGS. 11 and 12, the equicurrent bridge plate 55 comprises an upper horizontal part $P_3$ and two inclined planes $P_1$ and $P_2$ which form an angle $\theta$ with the horizontal.

Figure 14:
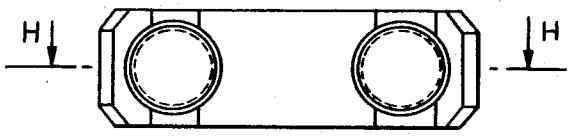
Figure 13:
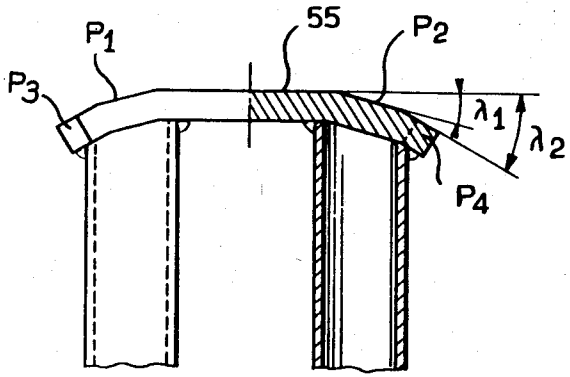

In FIGS. 13 and 14, the equicurrent bridge plate 55 comprises an upper horizontal portion $P_3$ and two pairs of inclined planes $P_1$ and $P_2$, $P_3$ and $P_4$ which form with the horizontal two angles $\lambda_1$ and $\lambda_2$.

The support means for the resistances of industrial high temperature electric furnaces, by ventilated means permitting to lower the temperature of the most highly mechanically stressed elements, may be provided by a mounting tube bent to shape as described above. It can also be provided by the device described hereinafter, with respect to FIG. 15.

A hollow vertical refrigerated mounting tube 45, of the same composition as the heating elements, is welded at its lower end to the bridge plate 55 connecting the upper ends of the two elements or successive heating tubes 57*a*, 57*b*. It passes through the insulation 51 of the arch 74 to open below the external casing 26 of the furnace on which it bears by means of an insulating plug 27 with a shoulder that ensures its electrical insulation with respect to the metallic structures of this casing.

In the interior of this hollow refrigerated mounting tube 45 is disposed concentrically with the bore, a vertical refrigerating tube 33, open at its two ends. Between the hollow refrigerated mounting tube 45 and the internal refrigerant tube 33 is thus created an annular space 72 which is obstructed at the upper end 70 of the hollow refrigerated mounting tube 45. Immediately below this obstruction, the hollow refrigerated mounting tube 45 is provided with a lateral opening 42 through which is introduced the cooling fluid, for example air at ambient temperature. This fluid first descends in the annular space 42, cooling the internal wall of the hollow refrigerated mounting tube 45 which serves as a mounting, then reaches the lower end 68 of the hollow refrigerant tube 33; it enters into the refrigerant tube 33 to reascend internally and finally leaves by the upper end 34 of this refrigerant tube 33. This fluid has the same function as that circulating in the tube bent of the first arrangement. It effects indirectly a cooling of the bridge plate 55 and of the welds 56 of the latter with its two hollow vertical heating tubes 57 with a thermal path more direct than that in the first hairpin shaped arrangement. Thus the thermal energy, given off by the Joule effect along its path, and the calories provided by conduction and proceeding from the heating tubes 57, flow toward the back of the bridge plate 55, then through the wall of the hollow refrigerant mounting tube 45 and reascend, by the refrigerant tube 33, until the cooling fluid has absorbed them.

An appropriate control, effected once for all time, of the level of the lower end of the mounting tube, and the control of the output flow of fluid, permit regulating the temperature of the bridge plate 55 to about that of the furnace 1, and thus a gain of several dozen degrees, particularly beneficial given the temperature level of the metal of the bridge plates 55.

Moreover, there is no longer parasitic thermal penetration as is the case with the mounting tube of the first embodiment in which a portion of the mounting tube is subjected to the furnace ambient, attenuated by the insulation coating which covers said mounting tube.

The technical characteristics described above, provide an interchangeable modular heating element 75. This interchangeable modular heating element 75 is comprised by a body 26 or structure, two current supply terminals 64, hollow refrigerated mounting tubes 45, heating tubes 57, bridge plates 55, and associated insulation 51. This modular interchangeable element 55 permits rapid external replacement in case of failure without waiting for the furnace 1 to be cooled (see FIGS. 16 and 17).

What is claimed is:

1. A high temperature electric furnace having electric resistances therein which are vertical hollow heating tubes, electrically conductive bridge plates interconnecting the upper ends of each adjacent pair of tubes, electrically conductive bridge plates interconnecting the lower ends of each adjacent pair of tubes so as to complete a sinuous electrical path along the tubes, and hangers secured to the upper bridge plates and suspending the tubes within the furnace, each of said bridge plates being an obtuse angled dihedral whose obtuse angle opens toward the tubes to which it is connected.

2. A furnace as claimed in claim 1, in which said bridge plates are solid metal bars that close the ends of the tubes and are welded to the tubes.

3. A furnace as claimed in claim 1, in which said hangers are welded to said bridge plates each by a continuous line of welding.

4. A furnace as claimed in claim 1, in which said tubes are welded to said bridge plates by continuous lines of welding.

5. A high temperature electric furnace having electric resistances therein which are vertical hollow heating tubes, electrically conductive bridge plates interconnecting the upper ends of each adjacent pair of tubes, electrically conductive bridge plates interconnecting the lower ends of each adjacent pair of tubes so as to complete a sinuous electrical path along the tubes, hangers secured to the upper bridge plates and suspending the tubes within the furnace, said hangers being hollow, and means to force a cooling fluid through said hollow hangers.

6. A furnace as claimed in claim 5, in which said hangers are a pair of concentric tubes spaced one within the other, a portion of the path of said cooling fluid lying between said tubes and another portion of the path of said fluid lying within the inner of said tubes.

7. A furnace as claimed in claim 5, said hanger being of hollow U-shape and said cooling fluid passing therethrough.

8. A furnace as claimed in claim 5, the furnace having a roof and said hangers passing through and being suspended from the roof.

9. A furnace as claimed in claim 5, the entry and exit of said cooling fluid into and from said hollow hangers being located above said roof.

10. A high temperature electric furnace having a roof and electric resistances within the furnace which are vertical hollow heating tubes, electrically conductive bridge plates interconnecting the upper ends of each adjacent pair of tubes, electrically conductive bridge plates interconnecting the lower ends of each adjacent pair of tubes so as to complete a sinuous electrical path along the tubes, and hangers secured to the upper bridge plates and suspending the tubes within the furnace, said hangers extending through said roof and suspending the tubes from the roof and constituting the sole support of the tubes within the furnace.

* * * * *